US005868637A

United States Patent [19]

Poxon

[11] Patent Number: 5,868,637

[45] Date of Patent: Feb. 9, 1999

[54] SPORT OR GAMES APPARATUS

[75] Inventor: David Poxon, Wolverhampton, Great Britain

[73] Assignee: Brass Eagle, Inc., Rogers, Ark.

[21] Appl. No.: 845,620

[22] Filed: Apr. 25, 1997

[51] Int. Cl.[6] ..... A63B 71/02

[52] U.S. Cl. ..... 473/469

[58] Field of Search ..... 473/415, 465, 473/469, 471, 473, 474, 490; 472/92, 94, 136; 463/51, 52, 5, 50; 482/35, 36

[56] References Cited

U.S. PATENT DOCUMENTS

| | | | |
|---|---|---|---|
| 3,561,757 | 2/1971 | Schillig | 272/60 |
| 3,814,416 | 6/1974 | Munger et al. | 482/36 |
| 4,278,250 | 7/1981 | Baynes et al. | 482/36 |
| 5,226,864 | 7/1993 | Showers | 482/35 |
| 5,320,362 | 6/1994 | Bear et al. | 463/51 X |
| 5,575,120 | 11/1996 | Handley | 52/79.1 |

FOREIGN PATENT DOCUMENTS 373703 6/1932 United Kingdom .

*Primary Examiner*—William H. Grieb
*Attorney, Agent, or Firm*—Christie, Parker & Hale, LLP

[57] ABSTRACT

Apparatus for playing a sport or game, comprises a plurality of elongate members disposed upon a playing surface, at least some of said elongate members comprising tubular members, some of said tubular members being disposed in a vertical disposition and some being mounted between a vertically disposed member and the ground, to form an angle with respect to the ground, wherein the arrangement of tubes presents an environment for playing the sport or game in which players can move on the ground surface between tubes to be at least partially hidden by tubes from opposing players.

14 Claims, 3 Drawing Sheets

SPORT OR GAMES APPARATUS

FIELD OF THE INVENTION

This invention relates to sport or games apparatus. In particular, but not exclusively, it relates to sporting apparatus for use in a game such as a paintball game in which players from opposing teams strive to achieve a designated objective and to stop the other team from achieving the same objective over a defined area of ground and in which projectiles such as paintballs fired from guns are employed by the team members to assist them. The invention may also be applicable to games such as ones in which the players are equipped with lasers firing harmless, low power, laser beams or other types of sport or games.

Traditionally, paintball games have taken place in woodland. The game of paintball involves team and players equipped with guns which fire paintballs (typically .68 calibre). When a paintball hits a target, it leaves a clearly identifiable mark on that target. By this means, opposing players are eliminated from the game. Each team is generally required to capture a token such as a small flag from the opposing team's base. Games are usually marshalled by referees. The nature of the woodland environment in which games are played tends to mean that every game and every game site is unique, but also is extremely difficult to spectate or to televise. Cheating is also common since it is generally difficult for referees to see where every player is.

Attempts have been made to bring paintball into a more organised stadium type of environment. Up to now, such attempts have only met with limited success for several reasons. Firstly, pitches are not standardised and therefore it is difficult to compare performances. Games tend to become rather two-dimensional and obstacles, if they are provided, tend to be flat ones providing player cover. This generally two-dimensional aspect of play means that the games becomes very different from those played in woodland and have extremely limited tactical possibilities. Also such games often do not look particularly impressive. The obstacles or barricades which have been used in such games in the past tend to have angular edges, usually square or rectangular. The edges of the obstacles or barricades tend to limit positioning of players and to become a target area for opposing players.

It is an object of the present invention to provide an improved apparatus for the playing of paintball type games.

BRIEF SUMMARY OF THE INVENTION

According to the present invention, there is provided apparatus for playing a sport or game, comprising a plurality of elongate members disposed upon a playing surface, at least some of said elongate members comprising tubular members, at least one of said tubular members being disposed in a vertical disposition and at least one being mounted between a vertically disposed member and the ground, to form an angle with respect to the ground, wherein the arrangement of tubes presents an environment for playing said sport or game in which players can move on the ground surface between tubes to be at least partially hidden by tubes from opposing players.

At least some of the tubular members may be of sufficient internal diameter for a person to crawl inside them.

The arrangement of members may be symmetrical about a midline of the playing surface. The playing surface may be a pitch and may be in a stadium, having at least one area for spectating.

The arrangement of the members is preferably such that from a player's viewpoint on the playing surface a pattern of diminishing lines and broken angles is provided which substantially results in a player having very difficult vision beyond the centre of the pitch.

Preferably the spectators are positioned at a specific point or group of points at which the elongate members are arranged to present reverse perspective such that objects appear to get bigger as they recede away from the spectators.

BRIEF DESCRIPTION OF THE DRAWINGS

Embodiments of the invention will now be described, by way of example only, with reference to the accompanying drawings in which.

DESCRIPTION OF THE PREFERRED EMBODIMENTS

Figure 1:
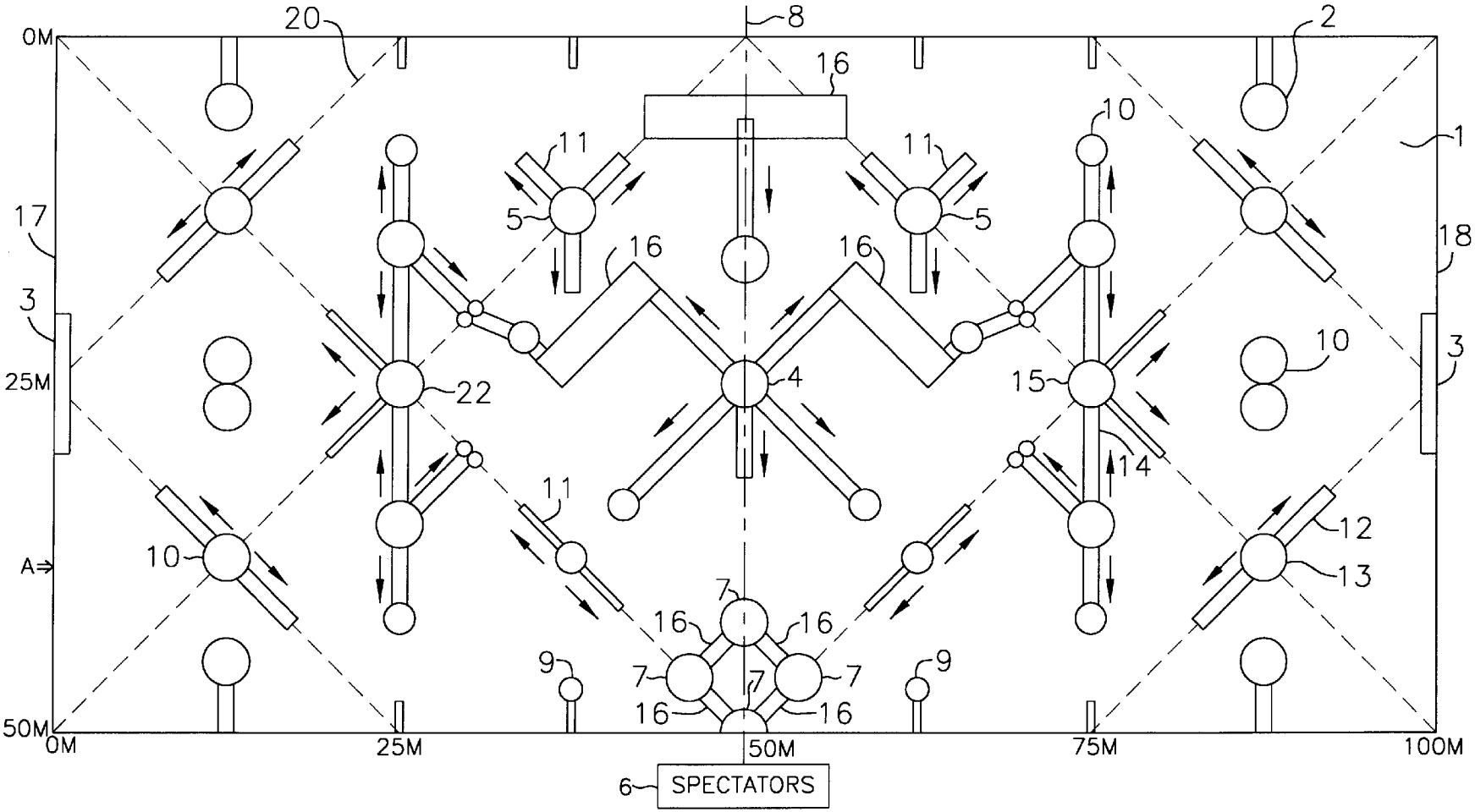
FIG. 1 shows a plan view of a playing area for a paintball game.

Referring to FIG. 1, a pitch suitable for playing games such as paintball games, or indeed other games such as laser games, may typically be of around 100 metres by 50 metres. This dimension is arbitrary and may vary depending upon the circumstances.

Mounted upon the pitch 1 are a plurality of tubes 2 of which some tubes are vertically disposed and others are mounted at angles to the ground. The arrangement shown in FIG. 1 is by way of example only and many different arrangements of upright (i.e., vertical) and angled tubes may be used.

In general terms, two teams of players are equipped with weapons such as paintball guns and play a paintball game on the pitch to a designated set of rules. Rules may involve, for example, each team having a base board 3 at opposing ends of the pitch and having to kidnap an opponent's flag or other token which is placed at the opponent's base. Each team tries to stop the other team from achieving their objection by firing paintballs at them. If a person is hit by a paintball then that person is out of the game. The varying tubes present obstacles behind which players may hide and manoeuvre and at least some of the tubes may also be entered, e.g. by crawling into or through them, to provide further variations of play.

The tubes used to provide obstacles and cover on the pitch are generally of a plastics material, typically a thermoplastic copolymer material such as polypropylene. In a preferred embodiment, the tubes vary in diameter from 150 to 900 mm, but this may of course be varied for different embodiments.

A central, vertically mounted, tube 4 may be of any desired width and a height of about 4 metres. Two further vertical tubes 5 are arranged further away from a spectating area 6, offset from the line between the mid-point of the spectating area and central tube 4, as shown. These may be also of height 4 metres. Four additional vertical tubes 7, each of 1 meter in height are disposed closer to the spectator area 6 in a generally diamond configuration symmetrical about the midline 8 of the pitch. Further 1mm height vertical tubes 9 may be disposed closer to the spectators than central tube 4, as shown in the figure.

A plurality of further vertical tubes are each illustrated by circles in the figure and each of these may be of 2 metre height. Typical ones are referenced by numeral 10.

A further plurality of sloping tubes are arranged, which each have one end mounted at the top of a vertical tube, or at any intermediate position up the length of a vertical tube and their other end resting on the ground. These are illustrated by tubes such as 11 which are referenced by way of example only. The direction of slope in the sloping tubes is indicated by the direction of the respective arrow associated with that tube; the head of the arrow denoting the direction of the ground. Thus, sloping tube 12 extends from vertical tube 13 towards the ground direction (towards base board 3). The angled or sloping tubes may, in one embodiment, all be of 4 metres long. Preferably, at least some of the sloping tubes are of a different colour to the others. The two colours may be black and orange in one embodiment. Note that sloping tube 14 slopes downwards towards vertical tube 15.

Additionally, some tubes may be disposed in a horizontal position lying on the ground, such as tubes 16, of which four tubes are provided which "interconnect" vertical tube 7.

In addition, a more interesting game may be obtained by the inclusion of one or more large diameter tubes 16 which are preferably horizontally arranged to lie on a pitch but may also be sloping, and which are of sufficient diameter to enable a person to crawl into them and through them. Thus, tube 16 provides cover for a player actually inside them and enables players to hide and move undetected whilst inside them.

Additional or alternative obstacles of any configuration, not necessarily tubes, may be provided.

The advantage of tubular structures, or of other structures with non planar or non angular edges, is that both cover and opportunity for shooting from any angle or position is obtained. A flat barricade is not so useful for this purpose.

As mentioned above, the tubes may be arranged in very different dispositions to those shown in the preferred embodiment of FIG. 1. Most preferably, the principals behind the design are as follows:

The pitch layout is designed from two viewpoints, that of the players on the ground and that of the spectators in the spectating zone 6. Note that the spectating zone may be arranged in a tiered configuration for optimal viewing by all spectators.

The cone of vision of the eye expands outwards from its point of origin—the eye, in theory to infinity but in reality until it is dissected by objects within the field of view. The sharpest focus of the eye is at the point of centre of vision. Although the human eye is capable of seeing everything within an arc of substantially 180°, most of its vision is peripheral. The field of moderately sharp vision is from around 45° to 60° either side of the centre of vision and is sharpest near the centre. The players standing position, or a spectators viewing position and distance relative to an object (i.e., a tube) provides the angle of view and spatial relationship of the player to the tubes.

Figure 2:
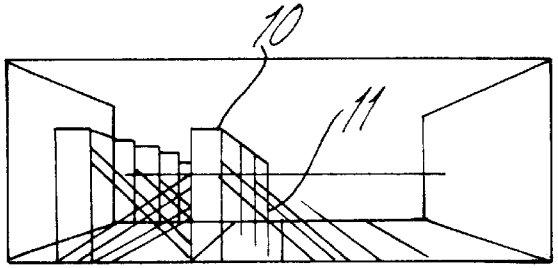
FIG. 2 shows schematically a view seen by a player.

From the players viewpoint, the objective of the pitch design is to create maximum low visibility, i.e., to simulate as far as possible a natural terrain, formed from trees and other obstacles. The cone of vision of the player is obscured firstly by the upright tubes which are arranged such that they recede in height visually away from a player (i.e., perspective) and from left to right across the field of vision (parallel to cone vision). The cone of vision is further obscured by the various cross member tubes 11 which are positioned such that they are either parallel to a player's standing position, or angled away from them in both vertical and horizontal planes. Tubes which are angled away in vertical and horizontal planes will tend to visually recede whereas those parallel to a player's standing position will not tend to. FIG. 2 shows, rather schematically, this concept as applied to the player's viewpoint. The figure illustrates a plurality of vertical upright 10 and angled tubes 11. From the player's position the offset nature of the uprights behind one another, and the associated sloping tubes, results in a pattern of diminishing lines and broken angles. The result is a very realistic one in which the players are unable to see substantially beyond the centre pitch point when they are standing at or near a respective end 17 or 18 of the pitch.

Figure 3:
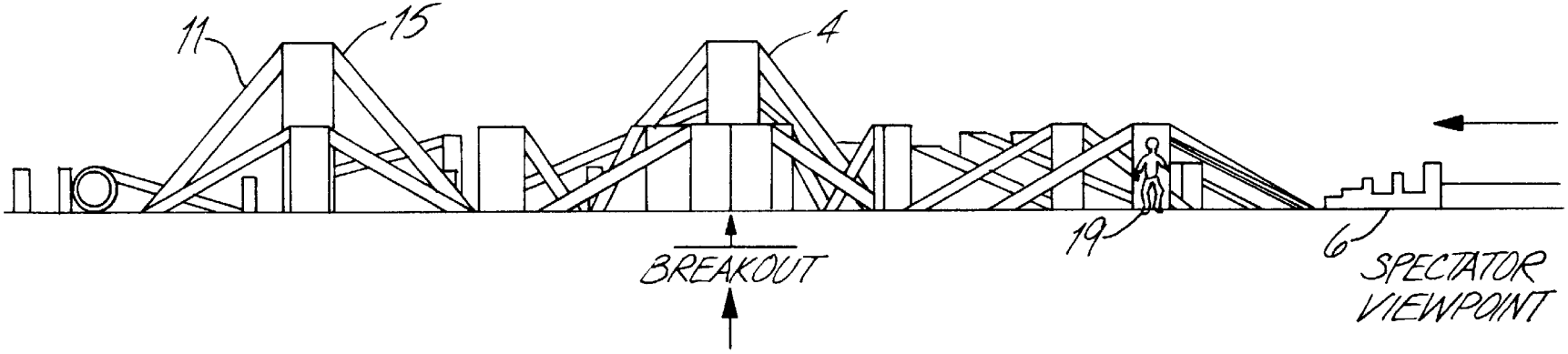
FIG. 3 shows a side view of the pitch of FIG. 1.

From the spectator's viewpoint, on the other hand, essentially reverse principles occur. In FIG. 1, tubes 7 and 9 (i.e., those closest to the spectators), are deliberately of lower height. Tubes such as tubes 13 and 15 are of medium height and tubes such as tube 4 are of maximum height. Thus, perspective is substantially rearranged for the spectator so that the height of the tubes closer to the spectator are smaller/lower and the gain in height is furthest away from the cone of vision. The spectators cone of vision is therefore not obscured and, in essence, reverse perspective is obtained such that objects will appear to be of substantially the same size over the spectator's field of view. FIG. 3 shows a schematic side view in a direction from arrow A of FIG. 1 and shows in particular tall uprights 4 and 15. From the spectator's viewpoint shown towards the right of the figure the uprights tend to increase in height as they recede away from him or her, tending to create a reverse perspective. A player is schematically shown at 19. From the player's perspective a mass of obscured visual images, vanishing lines and broken site lines is viewed. Thus, a realistic and difficult environment is obtained for the player whilst good viewing characterised are obtained for the spectator. It should be noted that for the perspective rules to work the spectators should all be positioned appropriately. Thus, in the example shown in FIG. 1 the spectators should all be sat along one edge of the pitch, preferably within a defined region 6.

As is shown in FIG. 1, each half of the pitch is a mirror image of the opposite half in the preferred embodiment. That is, the pitch is generally symmetrical about midline 8. This provides for player disorientation and provides more skilful games.

An additional feature that will be observed from FIG. 1 is that in a preferred embodiment the obstacles tend to be lower in height and more spaced apart than the centre and far sides. This enables spectators to get a full view of the game in progress.

At each end of the pitch there is provided a "break-out" board 3 (which may be similar to goal posts for example). In rules of the game, teams start the game from behind the break-out boards 3. Teams eliminate opposing players by shooting them with paintballs to score points and must capture the flag of the opposing team and return the flag to their own break-out board to win the game. Generally, with a pitch of 50 by 100 metres games will be usually last between about ten and fifteen minutes, depending upon the size of the teams.

Figure 4:
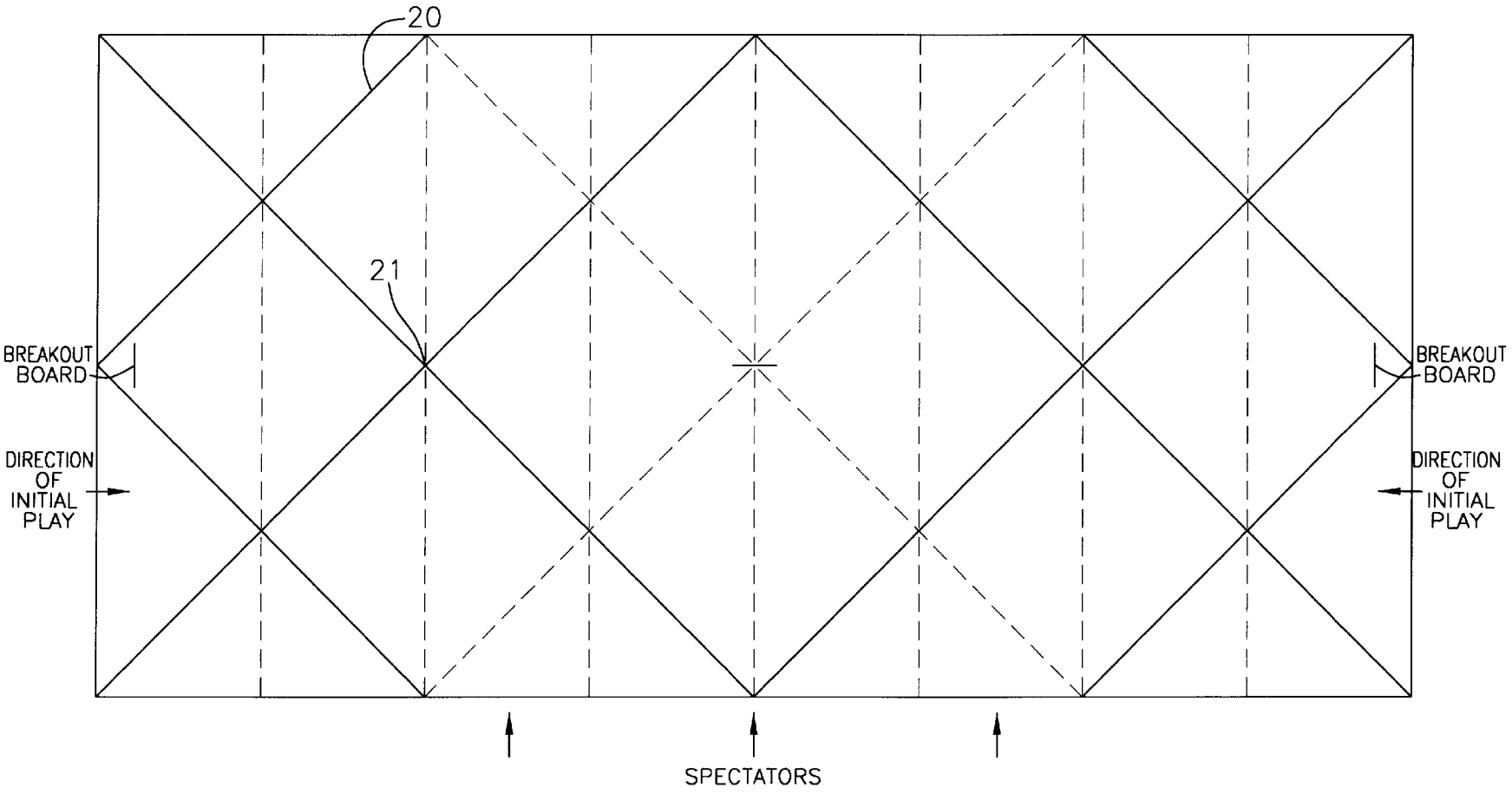
FIG. 4 shows the pitch before obstacles and other components have been placed upon it.

As is shown more clearly in FIG. 4, the obstacles are positioned based upon a pattern of diagonal lines 20 marked upon the pitch. These diagonal lines are also indicated by dashed lines in FIG. 1. In order to be able to achieve a desired pattern of diagonal lines, the pitch should be twice as long as it is wide. Preferably, it is 100 metres long by 50 metres wide but it may be of other dimensions. The intersections 21 where diagonals 20 cross tend to be key areas for defence and attack. It is preferable that tubes large enough to provide all round cover for one man are placed at these points, such as tube 22 in FIG. 1. The nature of the tube provides various angles for fire since tubes have no "edge". Other tubes are spaced proportionally along the diagonals 20, replicating tree trunks for example. Sight lines of players are further broken by angled tubes slotted into uprights and these replicate tree branches. In order to secure the various angled tubes to the various upright tubes, the upright tubes may be provided with slots or holes at appropriate positions such that the angles of tubes may be merely slotted into them. Other means, such as additional mounting members, or preformed protrusions, may be used to interconnect the various tubes.

Large tubes such as tube 16 which are of sufficient internal diameter for players to crawl through them, may be strategically placed lying along the ground, preferably parallel to the diagonals. These represent falling trees and also give the ability for players to disappear from view completely.

I claim:

1. An apparatus for playing a sport or game comprising:

a plurality of elongate members positioned upon a playing surface wherein at least a portion of the elongate members are tubular members, a first portion of the tubular members are positioned vertically upon the playing surface and a second portion of the tubular members extend at an angle from the vertical tubular members to the playing surface, the tubular members are of at least two different lengths; and a spectating station adjacent the playing surface wherein the vertical tubular members are arranged such that at least some of the vertical tubular members increase in length and height relative to each other as a distance from the spectating region increases and wherein the arrangement of elongate members presents an environment for playing the sport or game wherein players can move on the ground surface between the elongate members to be at least partially hidden from opposing players by the elongate members.

2. The apparatus of claim 1 wherein at least some of the tubular members are sufficient.

3. The apparatus of claim 1 wherein the arrangement of tubular members is symmetrical about a midline of the playing surface.

4. The apparatus of claim 1 wherein the playing surface is rectangular and the spectating region is disposed adjacent one long edge of the playing surface.

5. The apparatus of claim 1 wherein the elongate members are disposed such that a player sees an array of vertical and angled tubular members.

6. The apparatus of claim 1 wherein a pattern of diagonal lines is marked on the playing surface, the diagonal lines having a plurality of intersection points between them and wherein a vertical tubular member is provided at least some of the intersection points.

7. The apparatus of claim 1 wherein the sport or game is paintball.

8. The apparatus of claim 1 further comprising at least one horizontally extending tubular member positioned on the playing surface.

9. An apparatus for playing a sport or game comprising:

a plurality of elongate members positioned upon a playing surface wherein at least a portion of the elongate members are tubular members, a first portion of the tubular members are positioned vertically upon the playing surface and a second portion of the tubular members extend at an angle from the vertical tubular members to the playing surface, the tubular members are of at least two different lengths; and break-out boards positioned at opposite ends of the playing surface wherein the vertical tubular members recede in height away from the break-out boards and from side to side of the playing field.

10. The apparatus of claim 9 wherein at least some of the tubular members are of sufficient internal diameter for a person to crawl inside.

11. The apparatus of claim 9 wherein the arrangement of tubular members is symmetrical about a midline of the playing surface.

12. The apparatus of claim 9 wherein the elongate members are disposed such that a player sees an array of vertical and angled tubular members.

13. The apparatus of claim 9 wherein a pattern of diagonal lines is marked on the playing surface, the diagonal lines having a plurality of intersection points between them and wherein a vertical tubular member is provided at least some of the intersection points.

14. The apparatus of claim 9 wherein the playing surface is rectangular and the break-out boards are disposed along opposite short edges of the playing surface.

* * * * *